US006099395A

United States Patent [19]

Guseman

[11] Patent Number: 6,099,395

[45] Date of Patent: Aug. 8, 2000

[54] COLLAPSIBLE SANDBLASTING CABINET

[76] Inventor: Benny Guseman, 11414 O'Donnell, Houston, Tex. 77076

[21] Appl. No.: 09/229,773

[22] Filed: Jan. 13, 1999

[51] Int. Cl.[7] ..... B24C 9/00

[52] U.S. Cl. ..... 451/75; 451/87; 451/89

[58] Field of Search ..... 451/87, 89, 75, 451/90, 451, 38, 39, 40

[56] References Cited

U.S. PATENT DOCUMENTS

| | | | |
|---|---|---|---|
| D. 323,661 | 2/1992 | Zwicker | D15/124 |
| 1,670,026 | 3/1928 | De Lano | 312/258 |
| 1,773,374 | 8/1930 | Ruemelin | 451/89 |
| 1,987,378 | 1/1935 | Tansley | 220/6 |
| 2,321,774 | 6/1943 | Ruemelin | 451/89 |
| 2,584,647 | 2/1952 | Webber | 451/89 |
| 2,730,420 | 1/1956 | Bruck | 312/213 |
| 3,352,063 | 11/1967 | Eppler | 451/89 |
| 3,407,941 | 10/1968 | Schmidt | 211/177 |
| 3,410,441 | 11/1968 | Rhyne | 220/4 |
| 3,505,945 | 4/1970 | Greer | 98/115 |
| 3,599,375 | 8/1971 | Nunemaker | 451/89 |
| 4,084,357 | 4/1978 | Moses | 451/89 |
| 4,300,318 | 11/1981 | Brown | 451/88 |
| 4,375,740 | 3/1983 | Brown | 451/88 |
| 4,579,401 | 4/1986 | Mears | 312/258 |
| 4,787,179 | 11/1988 | Lewis | 451/89 |
| 4,866,889 | 9/1989 | Goldmann | 451/89 |
| 5,308,157 | 5/1994 | Dyer | 312/258 |
| 5,427,199 | 6/1995 | Jorgensen et al. | 451/89 |
| 5,460,564 | 10/1995 | Bowes et al. | 451/89 |
| 5,649,850 | 7/1997 | Lyras et al. | 451/87 |
| 5,971,837 | 10/1999 | McDavid | 451/89 |

*Primary Examiner*—M. Rachuba
*Attorney, Agent, or Firm*—Sankey & Luck, L.L.P.

[57] ABSTRACT

A collapsible spray cabinet for containing an abrading device and an article to be abraded includes a flexible cabinet housing having an expanded position for defining an interior blasting chamber and a collapsed position for storage. A folding frame supports the cabinet housing and has an open position in which the cabinet housing is held in the expanded position and a closed position in which the cabinet housing is held in the collapsed position. The frame has a base, vertically disposed support members, horizontal loading members, and spacing members. The spacing members are pivotally connected to the loading members, allowing them to pivot about each other to form a substantially flat unit when in the closed position. Loops suspend the cabinet housing from the loading members of the folding frame. An aperture lets in a current of air into the blasting chamber continuously to clear the area of the blasting chamber between a viewing portal and a member supporting the article to be abraded.

23 Claims, 6 Drawing Sheets

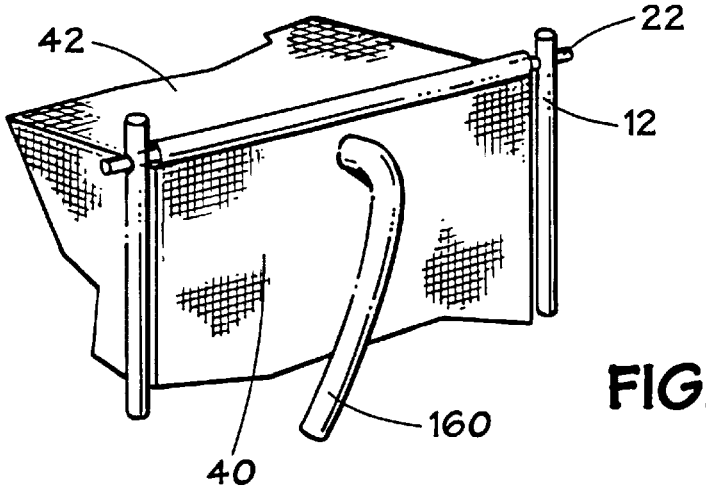
FIG. 3
FIG. 4
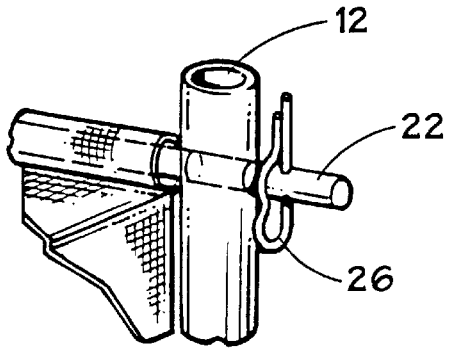
FIG. 5
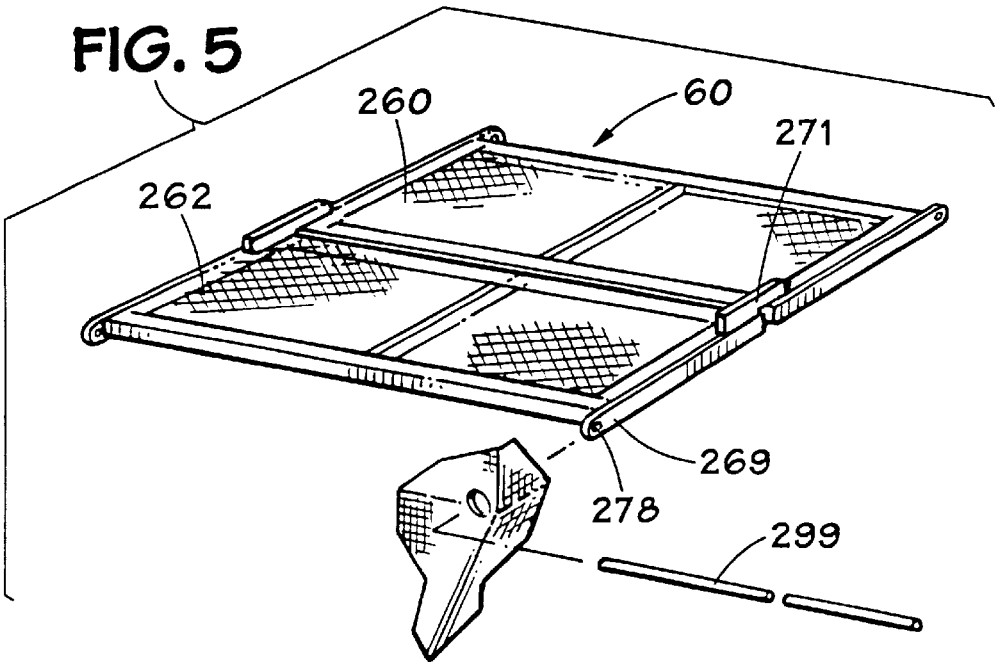

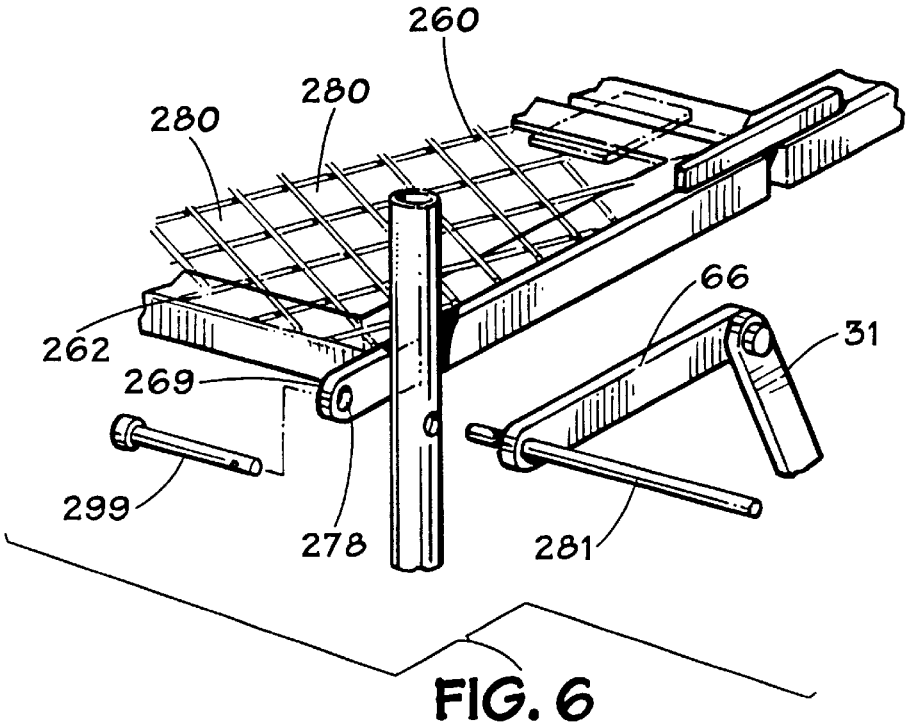
FIG. 6
FIG. 8
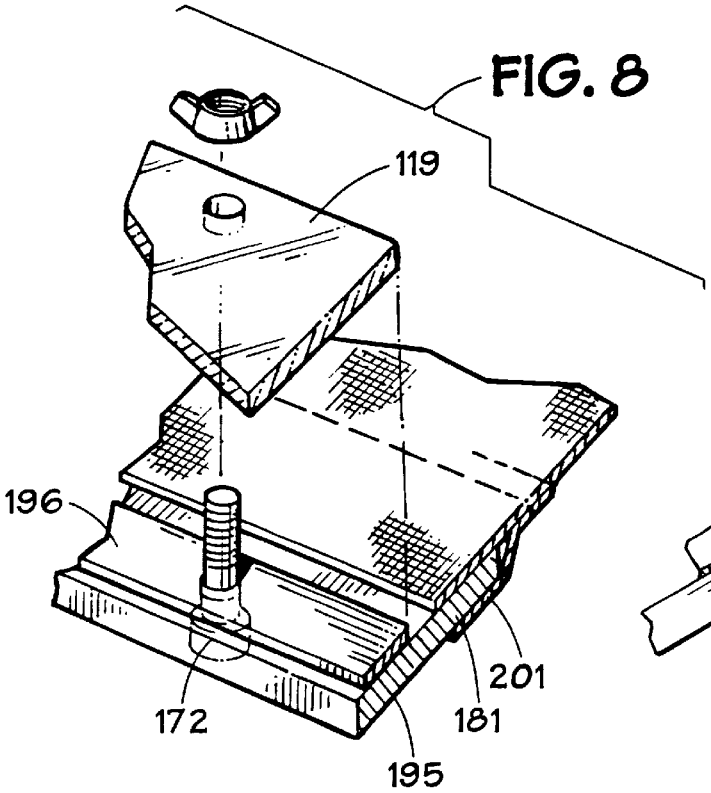
FIG. 7
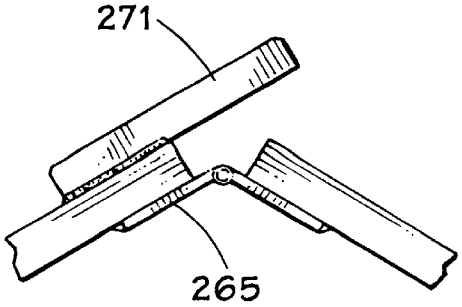

COLLAPSIBLE SANDBLASTING CABINET

BACKGROUND OF THE INVENTION

1. Field of the Invention

The present invention generally relates to abrasive blasting assemblies. More specifically, the present invention relates to a collapsible, abrasive blasting system which is readily portable.

2. Description of the Prior Art

Sandblasting is a well known operation wherein a stream of fluid, such as air or water, containing a suspended granular material is directed against a workpiece. The abrasive nature of the stream cleans or erodes the workpiece on which the stream is directed.

Initially, abrasive blasting was commonly performed using an air compressor and the abrasive, most commonly sand, in a non-contained or open environment. Unconstrained spraying of the abrasive medium had the effect of creating a "sandstorm" in the immediate area of the workpiece. Further, the granular or abrasive material was not recaptured and recycled, thereby adding to the inefficiency of the sandblasting process.

Recognizing these limitations, cabinets were developed to enclose the workpiece and to contain and recapture the abrasive medium.

For over 50 years, sandblast cabinets have been marketed towards industrial applications such as commercial automobile repair and restoration. Industrial-type cabinets are sold as preassembled units and often have welded seam construction. These cabinets are very large, to accommodate a wide variety of work pieces, and may vary in cost from $600.00 to over $4,400.00 depending on their size.

Because of their size and permanent preassembled construction, prior art industrial abrasive cabinets require shipping via commercial freight carrier. The high cost of preassembled, industrial cabinets in combination with the shipping cost makes these cabinets prohibitively expensive for the home market such as automobile repair and restoration hobbyists.

Because of their size, previous abrasive blasting assemblies have also lacked ready application in the field since they were not easily portable. As a result, abrasive cleaning or finishing services were usually required to be conducted in a shop or office, thereby reducing convenience and exacerbating costs.

SUMMARY OF THE INVENTION

The present invention addresses the above and other disadvantages of prior art abrasive blasting assemblies by providing a system which is both lightweight and portable.

In one embodiment, the present invention comprises a housing which includes opposing side, top and bottom elements, where such housing is supported by a collapsible, lightweight framework so as to define an interior chamber. It is contemplated that the housing elements are comprised of a rubberized fabric. A collapsible working platform to support the workplace is secured in the chamber and is also supported by the frame.

Access to the workpiece is enabled by glove assemblies which extend into the chamber. A transparent panel or window is provided on at least one wall of the housing to allow visual inspection of the workpiece during the blasting operation. The housing is further provided with an air exhaust and an air inlet to maintain visibility inside the chamber during the blasting operation.

Used abrasive medium and debris from the workpiece are collected at the bottom chamber in a funnel shaped bottom piece in the bottom or floor element. This bottom piece may include a valve or other means to regulate the flow of the abrasive medium out of the bottom of the chamber for purposes of collection and reuse.

The present invention presents a number of advantages over prior art systems. One such advantage is the lightweight nature of the system which in a preferred embodiment may only weigh some thirty pounds. Such light weight makes the system readily portable from job site to job site and further decreases transportation and delivery costs.

A second advantage of the present invention is its ability to be collapsed into a readily storable and/or transportable size and shape. This feature further facilitates its ability to be readily transported and shipped.

Yet other advantages of the present invention will become obvious in view of the illustrations and the detail and description of the preferred embodiment.

BRIEF DESCRIPTION OF THE DRAWINGS

FIG. 3 illustrates a partial detail view of the vacuum outlet of the embodiment of Figure FIG. 4 illustrates a partial, detail view of the frame of the invention.

FIG. 5 illustrates the workpiece support means of the invention.

FIG. 6 illustrates a perspective, partially exploded view of the support means of FIG. 5 as it may be coupled to the frame.

FIG. 7 is a side view of the support means as it may be collapsed for purposes of transport and storage.

FIG. 8 illustrates a perspective, detail view of the one embodiment of the viewing portal of the invention.

DETAILED DESCRIPTION OF THE PREFERRED EMBODIMENT

Figure 1:
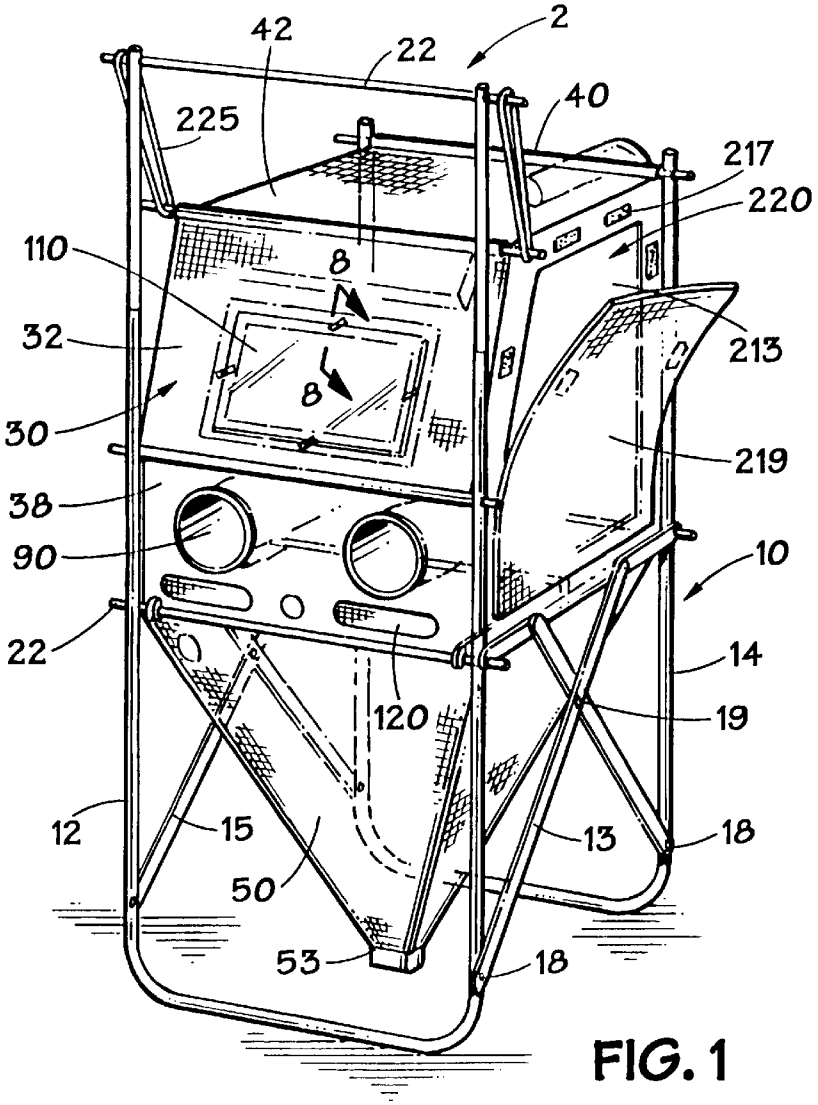
FIG. 1 illustrates a perspective view of one embodiment of the invention.

One embodiment of the sandblasting cabinet of the present invention may be seen by reference to FIGS. 1–8. FIG. 1 illustrates a perspective view of cabinet 2 which generally includes an external frame system 10, a containment assembly 30 and an internal workpiece support structure 260.

Figure 2:
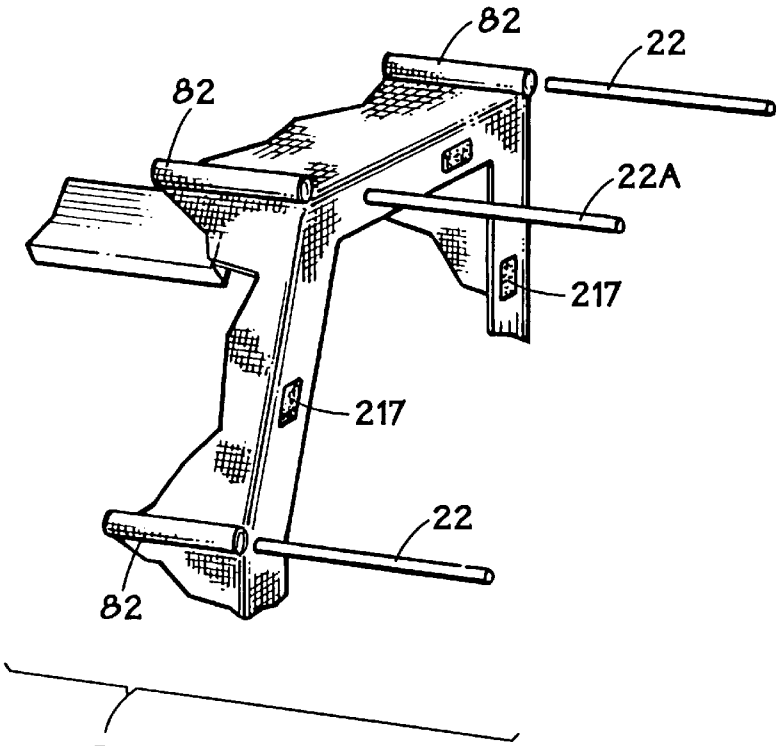
FIG. 2 illustrates a partial detail view of the embodiment illustrated in FIG. 1.

By reference to FIGS. 1–2, and 4, the sandblasting cabinet of the invention utilizes a plurality of external support members which are configured to provide maximum stability while reducing weight and allowing ready collapse and storage. In the illustrated embodiment, frame 10 comprises two U-shaped vertical support members 12 and 14, each said member comprising two support elements, as illustrated. Members 12 and 14 are secured in a spaced apart relationship by cross members 13 and 15, respectively.

In the illustrated embodiment, cross members 13 and 15 are pivotally secured at their lower ends to support members 12 and 14 via pins or fasteners 18 and are also pivotally joined at their midpoint 19. By reference to FIGS. 1 and 6, the upper portion 31 of cross members 14 and 15 are rotatably coupled to a bracket to 66 which in turn is pivotally coupled to a horizontal crosspiece 22, as will be explained more fully below. The resulting structure provides stability while allowing the combination to be easily collapsed.

Other configurations for frame 10 are also contemplated within the spirit of the invention. For example, it is contemplated that the frame systems may employ a system of three or more vertical support members which include graduated and slidable interconnected telescoping segments. It is also contemplated that the present invention may incorporate a wall or other fixed structure for at least partial support. Still other embodiments for a frame system are described below.

In the illustrated embodiment, members 12 and 14 are provided with a series of horizontal cross pieces 22 which support the containment assembly 30 and work piece support 60. These cross pieces may be formed of lightweight metal, fiberglass or other suitable material which is both adequately rigid yet lightweight. In the embodiment illustrated in FIGS. 1, 2 and 4, crosspieces 22 are adapted to fit through apertures formed in upright support members 12 or 14, where the terminal ends 25 of such crosspieces are secured by a key 26 or other conventional locking mechanism. In the embodiment of frame system employing telescoping vertical supports, horizontal cross pieces may be coupled to sleeves selectively slidable about said vertical members.

Containment assembly 30 encloses the workpiece during the abrasion operation and thus allows the operator to observe the abrasion operation while providing protection from hazardous dust. In one embodiment, assembly 30 comprises an upper body 32 and a funnel shaped, lower receptacle 50. Upper body 32 comprises two opposed side walls 34 and 36 and opposed front and back walls 38 and 40, where said walls are joined to a top element 42 and said receptacle 50, such that the combination defines an interior working chamber.

It is contemplated that the elements comprising assembly 30 be formed of a flexible fabric lined on the interior with a rubberizing element to minimize abrasion from the stream of abrasive particles. Alternatively, assembly 30 may be formed of plastic. Still other materials, e.g. vinyl, are also contemplated with the spirit of the invention.

Figure 11:
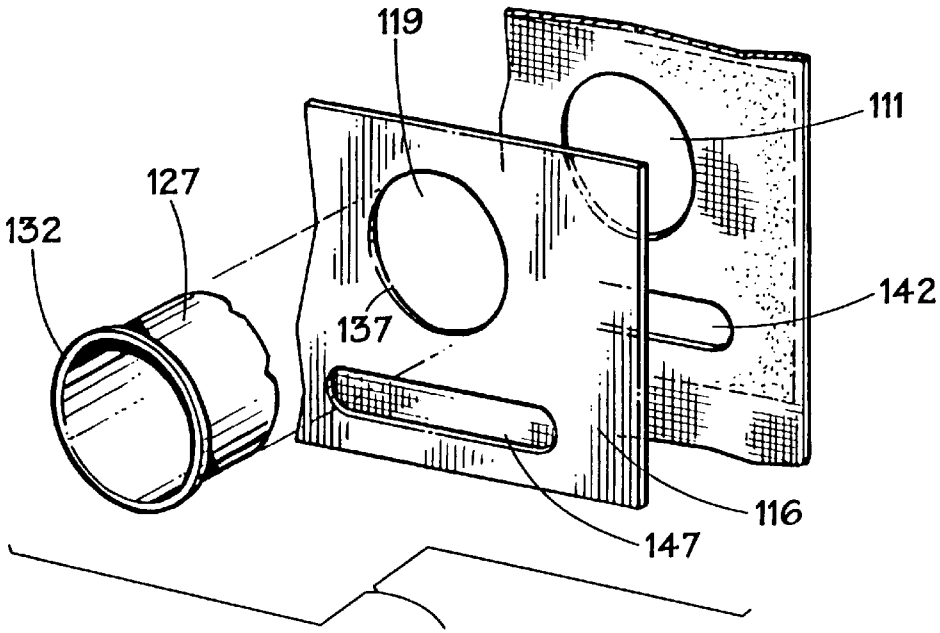
FIG. 11 illustrates a perspective, detail view of the glove box assembly of the present invention.

In a preferred embodiment, front element 38 includes a glove box assembly 90, a viewing portal 110 and air introduction means 120. By reference to FIG. 11, glove box assembly 90 is formed in the bottom half of front element 38 below portal 110 and comprises a pair of apertures 111 formed in said element 68 over which is affixed a semi-rigid facing element 116. Facing element also includes apertures 119 complementary to apertures 111 where such element 116 is used to strengthen said front element 65. It is contemplated that facing element 116 may be made from a plastic or a heavier cloth material.

In one preferred embodiment, facing element 116 includes a raised edge or lip 137 bounding aperture 119. A glove element 127, which itself comprises a flexible sleeve terminating in the form of a human hand, is inserted through apertures 119 and 111 and the open, proximal end 132 of said element 127 stretched to fit about said lip and secured with a ring or cap (not shown) designed to fit over lip in a conventional fashion. In such a fashion, glove elements may be readily replaced and/or interchanged. Alternatively, gloves may be glued to said lip 137.

For purposes of economy of design, it is contemplated that glove assembly 90 be formed in conjunction with air introduction means 120 which forms a slot 142 over which may be placed filter paper of a type to substantially prevent the discharge of abrasive particles. Alternatively, slat 142 may define a series of baffles to substantially reduce the external flow of abrasive particles. In operation, the introduction of an abrasive steam into the interior of assembly 30 creates a cloud of dust which greatly hampers visibility. The combination of the air introduced through inlet 147 and extracted through hose 160 creates a current which significantly diminishes this dust cloud and greatly enhances visibility.

Air means 120 allow air to be drawn into assembly 30 while the contaminated air within assembly 30 is evacuated through vacuum hose 160 (see FIG. 3), which is coupled in fluid communication with the interior of said assembly through rear wall 40. The opposite end of hose 160 is coupled to a conventional vacuum pump (not shown).

Front element 38 includes a viewing portal 110 which enables the operator to observe the abrading process. Portal 110 may consist of a transparent piece of glass 119, plastic or other substance which is secured over an aperture formed in front element 38. In the illustrated embodiment, frame member 181 includes a protruding lip 195 receivable to a gasket 196 over which is secured said pane 119, as discussed above. Alternatively, a plastic viewing portal may be zipped or snapped into place. Still alternatively, the need for a discrete viewing portal may be obviated by the use of a substantially transparent front panel.

It is contemplated that at least one of said side wall elements 34 or 36 be provided with means to insert or remove the workpiece. Such accessibility is also necessary to introduce the source of the abrasive portable stream. By reference to FIG. 1 and 2, it is contemplated that one of side walls 34 or 36 be provided with a resealable access portal 220 comprising a sub-wall element 219 formed in said sidewall and provided with means 217 to secure said sub-wall element, e.g. velcro or zipper fasteners 217.

In the illustrated embodiment, containment assembly 30 is suspended between frame 10 by a series of loops 82 which may integrally formed to the exterior of said assembly 30 so as to accommodate horizontal supports 22. It is also contemplated that loops 82 may be affixed to the exterior of assembly 30 via conventional processes, e.g. sewing or gluing.

In the embodiment illustrated in FIG. 1, the U shaped support element 12 supporting the front of structure 2 may extend above said containment assembly 30 in which case an adjustable suspension mechanism 225 may span between the topmost horizontal member 22B disposed in said element 12 and the horizontal support 22A disposed through the topmost external loop 82, as illustrated. In such a fashion, the relative position of viewing portal 110 to the user may be modified by adjusting tension on said mechanism 225 which may comprise an elastomeric component.

Figure 10:
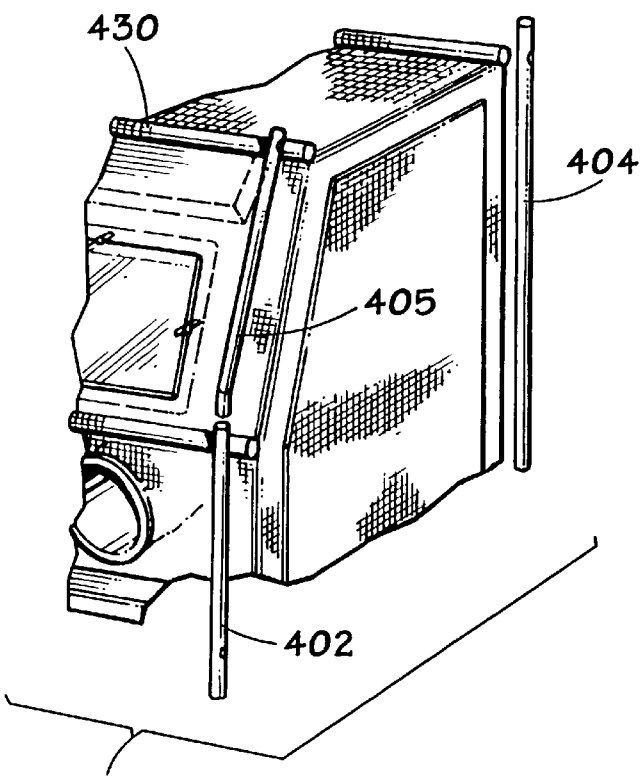
FIG. 10 illustrates a detail view of the frame of the embodiment illustrated in FIG. 9.
Figure 9:
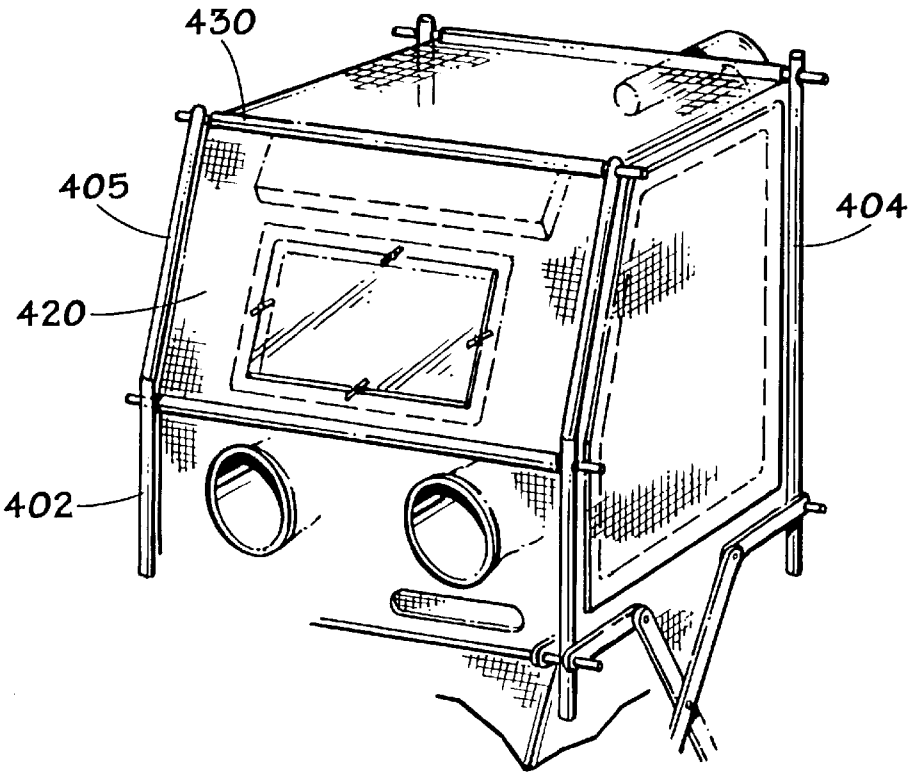
FIG. 9 illustrates a perspective view of an alternate embodiment of the invention.

An alternate embodiment of the support system may be seen by reference to FIGS. 9–10 in which is illustrated a support system which includes spaced apart front and back vertical supports 402, and 403, where said front support 402 include a separate support element 405 which is angled upwardly to accommodate the angled contour of the front face 420. As illustrated in FIG. 10, the lower portion of support element 405 may be adapted to fit in the topmost portion of front support 402. In such a fashion, topmost horizontal support 430 is disposed through and locked into support element 405. This alternate embodiment may provide for enhanced stability.

In an abrasion blasting operation, the operator directs a high velocity flow of air in which is entrained a stream of abrasive particles at a workpiece. For ease of manipulation, this workpiece is placed on a support structure 260 which is disposed inside containment assembly 30. By reference to the embodiment illustrated in FIG. 1 and 6–7, support structure 260 comprises a substantially flat top surface 262 which is formed in two parts about a midline 269 and includes a hinge mechanism 265. Hinge 265 is formed along the bottom side of structure 260 to allow said structure to fold upwards as illustrated in FIG. 7.

Stability of structure 260 when in an extended or "open" position is achieved by a mechanical stop 271 which may be affixed to one of the half sections defining structure 260. Top surface 262 is preferably comprised of an expanded metal defining a plurality of spaces or holes 280 there through to allow the abrasive material to pass through for collection in funnel 50, as will be described below.

Figure 12:
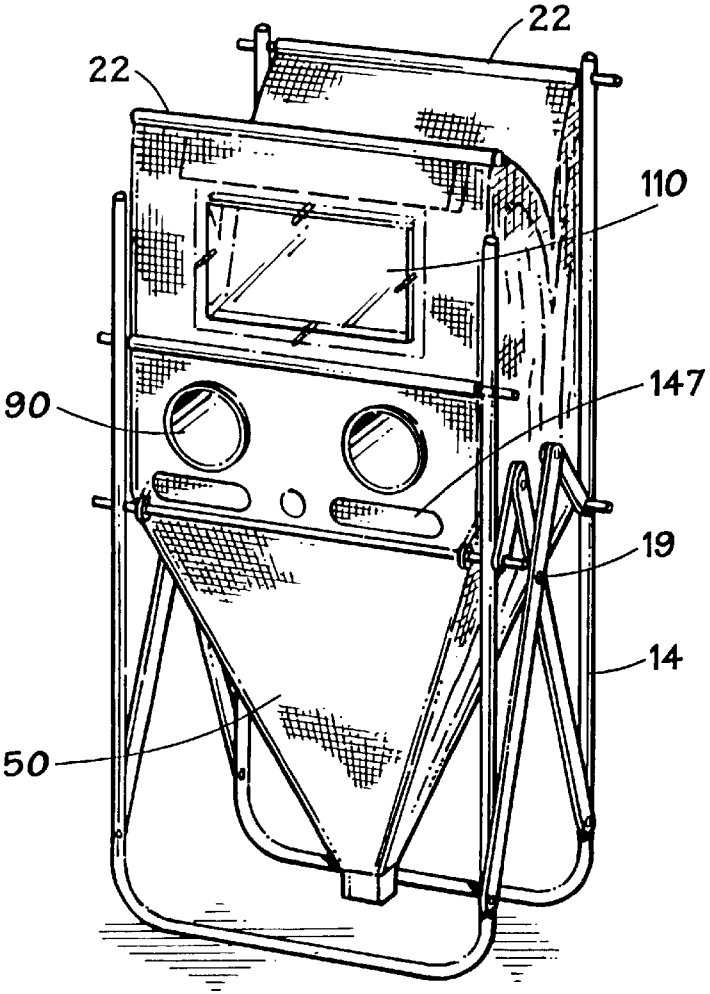
FIG. 12 illustrates a perspective view of the cabinet of the invention in a collapsed orientation.

In a preferred embodiment, support structure 260 defines a pivot bracket 269, where such bracket includes transverse apertures 278 through which may be fitted a pin 299 or, alternatively, an elongated support 261, which in turn is coupled to vertical support members 12 and 14. In such a fashion, the support structure 260 is able to allow for said structure 260 to pivot about said pin 299 when the collapse of structure 2 is desired (See FIG. 12).

Figure 13:
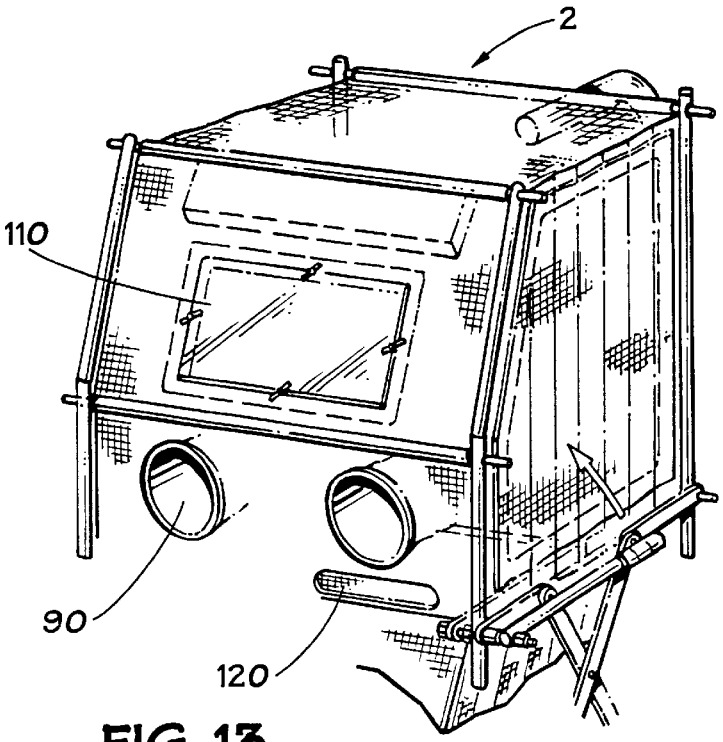
FIG. 13 illustrates a perspective view of an alternate embodiment of the invention including the use of an external mechanism to promote collapse.
Figure 14:
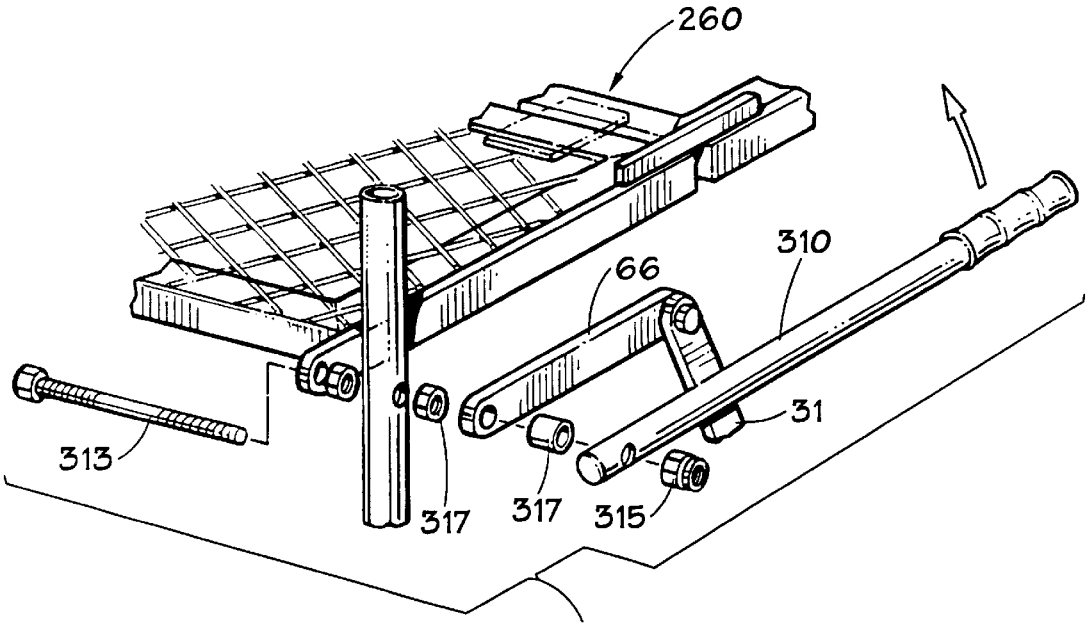
FIG. 14 illustrates an exploded, detail view of the embodiment of FIG. 13.

FIGS. 13–14 illustrated an alternate embodiment of the invention in which a handle 310 is operatively coupled to structure 260 to enable the user to collapse structure 260 by raising up on said handle 310 in the manner indicated. It is contemplated that handle 310 may be attached via the use of conventional fasteners, e.g., a bolt 313 and rivet 315, in conjunction with one or more spacers 317.

Used abrasive material and debris from the workpiece is collected in receptacle 50 which, as described above, generally describes a funnel shape to promote the ease by which such materials may be collected. In one embodiment, receptacle 50 may be provided with valving means at its extreme bottom end 53 to collect said abrasive materials. It is contemplated that said valving means may take the form of a restriction on said terminal end 53 which may be selectively released for purposes of collection. Alternatively, it is also contemplated that a more sophisticated recycling system may be employed wherein the abrasive blasting assembly is directly feed from said terminal end.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. In an abrasive blasting system including an abrading device for delivering a spray of abrasive particles in the direction of an article to be abraded, a collapsible spray cabinet for containing said abrading device and said abraded article, comprising:

a flexible cabinet housing having an expanded position for defining an interior blasting chamber and a collapsed position for storage, said housing including a bottom, a plurality of sidewalls and a top, where the combination defines said interior blasting chamber, at least one of said sidewalls having a cover member which may be opened to allow the placement of said article to be abraded through said sidewall into said blasting chamber;

a folding frame supporting said cabinet housing and having an open position wherein said cabinet housing is held in said expanded position and a closed position wherein said cabinet housing is held in said collapsed position, said folding frame including a base, a plurality of vertically disposed support members, a plurality of horizontal loading members, and a plurality of spacing members, said spacing members being secured to said supporting members and pivotally connected to said loading members so as to allow said loading members to pivot to form a substantially flat unit when said folding frame is in said closed position;

means for suspending said cabinet housing from said loading members of said folding frame;

a support element disposed in a spaced relationship to said bottom and said top for supporting said article to be abraded when said cabinet housing is in said expanded position;

access means for manipulating said abrading device from a position exterior to said cabinet housing;

a transparent viewing portal disposed in one of said sidewalls for allowing an operator to view the interior of the cabinet housing;

said bottom having a funnel shape for collecting spent abrasive particles;

an exhaust port disposed in one of said sidewalls for connecting to a source of vacuum; and means for providing the ingress of ambient air into said blasting chamber so as to establish a continuing current of air flow downwardly through said support element and through said exhaust port, whereby said current of air continuously clears said blasting chamber between said viewing portal and said support member.

2. The blasting system of claim 1, and wherein said support element comprises a plurality of spaced elements with openings therein which permit said spent abrasive particles and debris to pass downwardly into said bottom.

3. The blasting system of claim 2, wherein said bottom includes a bottom terminal portion, and means for preventing the escape of said spent abrasive particles and said debris from flowing through said bottom terminal portion.

4. The blasting system of claim 3, wherein said means for preventing includes a valve.

5. The blasting system of claim 1, wherein said access means includes glove elements affixed to one of said sidewalls of said cabinet housing.

6. The blasting system of claim 1, and further comprising a hinge element coupled to said support element and said frame, whereby said support element collapses to a substantially flat configuration when said folding frame is placed in said closed position.

7. The blasting system of claim 1, wherein said bottom, said top and said sidewalls are made from a rubberized fabric.

8. The blasting system of claim 1, wherein said support element comprises a hinge connecting a first portion and a second portion, said first and second portions pivoting about said hinge to collapse said support element when said folding frame is disposed in said closed position.

9. An abrasive blasting system comprising:

a flexible housing including a funnel shaped bottom element, a plurality of opposed side elements, and a top element;

a working platform disposed in said flexible housing and having a substantially planar top surface on which an article to be abraded may be placed;

manipulation means to allow the manipulation of said article to be abraded from a position exterior to said housing;

a viewing window disposed in at least one of said side elements so as to allow the inspection of said article to be abraded from a position exterior to said housing;

an air inlet and an exhaust portal disposed in at least one of said side elements of said flexible housing, said exhaust portal coupled to a vacuum source so that air flows from said air inlet to said exhaust portal through said flexible housing to maintain a clear field of view through said viewing window; and a collapsible frame coupled to said bottom, side and top elements for supporting said bottom, side, and top elements in a spaced apart relationship to define a blasting chamber.

10. The abrasive blasting system of claim 9, wherein said collapsible frame comprises:

a front element, a back element substantially parallel to said front element, a first side frame attached to said front frame and said back element, and a second side frame attached to said front and back elements, where said first and second elements are substantially parallel to each other, said first and second elements being pivotally mounted for simultaneous movement so as to expand said collapsible frame into a boxlike configuration.

11. The abrasive blasting system of claim 10, wherein said collapsible frame has an open orientation and a closed orientation, and wherein said flexible housing includes a plurality of loops formed in said housing elements, and wherein said collapsible frame includes connecting means coupled to said loops, said connecting means supporting said flexible housing in a spaced apart orientation when said frame assumes said open orientation, and a collapsed orientation when said collapsible frame assumes said closed orientation.

12. The abrasive blasting system of claim 9, wherein said system has an abrasive compound and debris, and wherein said working platform is formed from an expanded metal with a plurality of spaces therein through which said abrasive compound and said debris may pass.

13. The abrasive blasting system of claim 9, wherein said flexible housing is formed from a rubberized fabric.

14. The abrasive blasting system of claim 9, wherein said manipulation means includes a glove assembly secured to at least one of said side elements of said flexible housing.

15. The abrasive blasting system of claim 9, wherein said system has spent abrasive compound and debris, and wherein said bottom element further includes means to allow the collection of said spent abrasive compound and said debris.

16. A portable collapsible spray cabinet for containing an abrading device and an article to be abraded, comprising:

a flexible cabinet housing having an expanded position for defining a blasting chamber and a collapsed position for storage, said housing including a bottom, a plurality of sidewalls, and a top, at least one of said sidewalls having a removable cover member for allowing the placement of said article to be abraded through said sidewall into said blasting chamber, said bottom having a funnel shape for collecting spent abrasive particles and debris;

a folding frame supporting said flexible cabinet housing and having an open position wherein said flexible cabinet housing is held in said expanded position and a closed position wherein said flexible cabinet housing is held in said collapsed position, said frame including a base, a plurality of vertically disposed support members, a plurality of horizontal loading members, and a plurality of spacing members, said spacing members being secured to said support members and pivotally connected to said loading members whereby said loading members pivot to form a substantially flat unit when said folding frame is in said closed position;

connecting means for suspending said flexible cabinet housing from said loading members of said folding frame;

a support element disposed in a spaced relationship to said bottom and said top for supporting said article to be abraded when said cabinet housing is in said expanded position;

an access port for allowing an operator to manipulate said abrading device from a position exterior to said flexible cabinet housing;

a transparent viewing portal disposed in one of said sidewalls for allowing said operator to view the interior of said flexible cabinet housing;

an exhaust port disposed in one of said sidewalls for connecting to a source of vacuum; and means for supplying ambient air into said blasting chamber so as to establish a current of air flow downwardly through said support element and through said exhaust port, whereby said current of air continuously clears said blasting chamber between said viewing portal and said support member.

17. The spray cabinet of claim 16, wherein said support element comprises a plurality of elements spaced to form a plurality of openings therein to permit said spent abrasive particles and said debris to pass downwardly into said bottom.

18. The spray cabinet of claim 17, wherein said bottom includes a terminal portion, and means for preventing the escape of said spent abrasive particles and said debris from flowing through said terminal portion.

19. The spray cabinet of claim 18, wherein said means for preventing includes a valve.

20. The spray cabinet of claim 16, wherein said access port includes a pair of glove elements affixed to one of s aid sidewalls of said cabinet housing.

21. The spray cabinet of claim 16, and further comprising a hinge element coupled to said support element and said folding frame, whereby said support element collapses to a substantially flat configuration when said folding frame is placed in said closed position.

22. The spray cabinet of claim 16, wherein said flexible cabinet housing is made of a rubberized fabric.

23. The spray cabinet of claim 16, wherein said support element comprises a first portion and a second portion connected by a hinge, said first and second portions pivoting about said hinge to collapse said support element when said folding frame is disposed in said closed position.

* * * * *